US006572424B2

(12) United States Patent
Harkrider

(10) Patent No.: US 6,572,424 B2
(45) Date of Patent: Jun. 3, 2003

(54) PERSONAL SWIM CRAFT WITH AN UNDERWATER VIEWING AREA

(75) Inventor: Kent Harkrider, 412 Perry Pl., Carthage, TX (US) 75633

(73) Assignee: Kent Harkrider, Webster, TX (US)

( * ) Notice: Subject to any disclaimer, the term of this patent is extended or adjusted under 35 U.S.C. 154(b) by 0 days.

(21) Appl. No.: 10/084,171

(22) Filed: Feb. 28, 2002

(65) Prior Publication Data

US 2002/0115366 A1 Aug. 22, 2002

Related U.S. Application Data

(63) Continuation-in-part of application No. 09/404,243, filed on Sep. 22, 1999, now Pat. No. 6,241,569.

(51) Int. Cl.[7] ..... B63C 11/00
(52) U.S. Cl. ..... 441/135; 114/66
(58) Field of Search ..... 441/135; 114/66; 350/665, 895

(56) References Cited

U.S. PATENT DOCUMENTS

| | | | | | |
|---|---|---|---|---|---|
| 2,712,139 | A | * | 7/1955 | Kelly | 441/135 |
| 3,081,726 | A | * | 3/1963 | Betts et al. | 114/66 |
| 4,691,658 | A | * | 9/1987 | New et al. | 114/66 |
| 4,844,595 | A | * | 7/1989 | Nealy | 359/895 |
| 4,895,539 | A | * | 1/1990 | Bender | 441/135 |
| 5,447,459 | A | * | 9/1995 | Hammond | 441/135 |
| 5,476,055 | A | * | 12/1995 | Hackett et al. | 114/66 |

FOREIGN PATENT DOCUMENTS

| | | | | |
|---|---|---|---|---|
| GB | 2165186 A | * | 4/1986 | B63C/11/48 |
| GB | 2188881 A | * | 10/1987 | B63B/35/86 |

* cited by examiner

*Primary Examiner*—Jesus D. Sotelo

(57) ABSTRACT

A personal swim craft that has a liquid filled viewing area that is simply and inexpensively created within the craft requiring no tooling for molds or related costs. A walled cavity through the craft is sealed at its upper and lower openings with transparent panes. These panes are sealed in place without drilling or tapping holes or otherwise altering the surface area of the panes. The void between the transparent panes is filled with a transparent liquid via a vent that can be within the upper transparent pane or integrated into the craft adjacent to the upper pane and extending through the craft into the cavity void. The upper pane of the viewing area is slanted aft to allow extraneous water to run off into scuppers or vertical vents adjacent to the aft perimeter edge of the upper pane. These vertical vents and a forward set of vertical vents also remove air bubbles that may become trapped below the outer surface of the lower transparent pane. The transparent liquid, which could be within the viewing area cavity, is in essence a column of transparent liquid that rises above the level of water in which the craft is launched with the bottom pane of the viewing area within that water. The transparent liquid extends upward within the cavity to the upper transparent pane atop the craft. When a user lies prone on the craft, their forehead rest upon a head support placing the eyes over and within inches of the upper pane. The users head and face are not confined nor is peripheral vision restricted, making it safer to use. The user can lie prone or transposed upon the craft with head, neck, shoulders, arms, and back supported by the craft in an ergonomically stress free manner, best replicating that of a person floating in water. The craft with underwater viewing area can be used by the vast majority of people regardless of age, sex, or physical condition.

16 Claims, 12 Drawing Sheets

PERSONAL SWIM CRAFT WITH AN UNDERWATER VIEWING AREA

CROSS-REFERENCE TO RELATED APPLICATIONS

This application is a continuation in part of Ser. No. 09/404,243 my U.S. Pat. No. 6,241,569 issued on Sep. 22, 1999.

BACKGROUND

1. Field of Invention

This invention relates generally to underwater viewing devices and the flotation craft in which they are embodied, but more specifically to a comfort oriented craft that provides a crystal clear, trouble free, underwater viewing area embodied within it rather than a viewing device, with comfort and view replicating that which is experienced with conventional mask and snorkel use.

2. Description of Prior Art

It is not new knowledge that many people cannot use conventional masks and snorkels. This is apparent in the number of devices, crafts, and apparatuses that have emerged to aid these people.

Glass bottom boats and buckets with clear pane bottoms were probably first to appear, but they lacked the personal, up-close experience. Then somewhere, someone must have cut a hole in a surfboard or other such floating craft and affixed a clear pane of glass or other such transparent material to the bottom, and the glass bottom raft was born.

The commercial possibilities of such a device were then obviously realized and prior art began to appear. Problems early on were apparent. Condensation forming on the inside surface of the transparent pane was one such problem. This is the equivalent of fogging in a mask when diving or snorkeling. Another was the removal of water splashed by others swimmers or the user onto the inside surface of the viewing pane, obstructing the view. A problem again experienced with conventional mask and snorkel use when the seal of the mask around the users face is not complete and a leak results. Thereafter, inventors created several viewing devices and crafts to address these problems. These devices required expensive tooling for molds as well as a craft adapted or manufactured to accommodate such devices. These inventions addressed the aforementioned problems, but required the user to support their heads and shoulders to view into the viewing device because of collars, turrets, or nothing. The problem of keeping splashed or otherwise extraneous water from the viewing surface was addressed but not prevented.

Other solutions came in the form of molded facial supports, cowls, or masks to confine the face within to block extraneous water from entering the viewing surface of a single pane construction. Using multiple transparent panes eliminated water being trapped on the viewing surface and distorting the view, but required the users face to be confined over the viewing port to keep extraneous light from entering which would refract off of the transparent panes and negate the view below the surface of the water. These inventions not only created a claustrophobic environment by eliminating the users peripheral vision, but also a serious safety issue, especially when used in waters with boat traffic.

These inventions are as follows: Prior art describes several viewing devices that are part of the craft or flotation device that are used for underwater viewing. U.S. Pat. No. 2,712,139 issued on Jul. 5, 1955 to E. L. Kelly describes an underwater viewing device that is part of a flotation body. The underwater viewing device consists of a rectangular sleeve that resides inside a well that is formed within the flotation body. The sleeve is constructed of a metallic, plastic, or other rigid material. A viewing device for a flotation body is described in U.S. Pat. No. 4,844,595 issued on Jul. 4, 1989 to R. B. Nealy. In the preferred embodiment, the viewing device for flotation bodies comprises an open-ended cylindrical body and one transparent end wall. In another embodiment, a pair of transparent end walls at opposite ends of the cylindrical body are utilized. To one skilled in the art, prior art here requires expensive tooling for molds, nor does the viewing device provide for any measure of comfort.

U.S. Pat. No. 3,081,726 issued on Mar. 19, 1963 to W. M. Betts et al. describes a flotation body on which a person can rest and that is provided with a viewing window that is located and positioned such that a person resting on the float can look down into the water. This too requires expensive tooling to create a viewing device.

U.S. Pat. No. 4,691,658 issued on Sep. 8, 1987 to D. S. New et al. describes an aquatic sport device that includes a buoyant board configured for supporting a user in a prone position and sized to enable the user to manually paddle while in a prone position. A sight opening is provided through the buoyant board in an optical system configured for enabling the user to look through the board and perceive in a forward direction towards the bow of the buoyant board while paddling. An underwater viewing device is described in U.S. Pat. No. 4,895,539 issued on Jan. 23, 1990 to T. E. Bender. The underwater viewing device consists of a tube having a plurality of opaque sides that project upwardly from a horizontal planar surface made of a transparent material.

A buoyant board for viewing underwater objects while an observer is lying in a prone position is described in U.S. Pat. No. 5,447,459 issued on Sep. 5, 1995 to N. R. Hammond. The buoyant board has a seamless, unitary construction with a viewing well extending through the body of the board. That is integrally formed with the body. Prior art here requires the user to use their face to plug the upper opening of the well to prevent extraneous water and/or light from obstructing the view.

U.S. Pat. No. 5,672,082 issued on Sep. 30, 1997 to E. Binder describes a floating underwater viewing device. The floating underwater viewing device has a columnar configuration with top and bottom windows. A pair of toroidal floats are circumferentially disposed around the device.

A buoyant platform with a built-in transparent viewing panel is described in British Patent No. 2,165,186A published in April 1986. A raft with a window located at the bow end of the raft is described in British Patent document 2,188,881A published in October 1987.

A watercraft and viewing unit is described in U.S. Pat. No. 5,476,055 issued Dec. 19, 1995. The watercraft has a hull with a viewing opening therein extending between upper and lower portions of the hull. A transparent viewing unit is fitted within the viewing opening. Prior art again necessitates a viewing device in conjunction with a craft adapted for the device. Said viewing device will require expensive tooling for molds and a cowl or mask for the face to be placed into to prevent extraneous light from entering the viewing device which negates the view below the water.

None of the above inventions, taken singularly or in combination, is seen to describe the instant invention as claimed. The present invention appears to be singular in design and function.

SUMMARY

In accordance to the present invention, a specially designed craft with a liquid filled viewing area for viewing below the surface of the water, that posses nor requires a viewing device as such. The viewing area of the craft provides an open-air, non-restricted, clear and trouble free view of the underwater world with direct emphasis on comfort, simplicity, and function.

OBJECTS AND ADVANTAGES

Before the SCUBA mask and Aqua Lung were developed, the only means to explore the world below the surface of the water was with diving bells and heavy helmented diving suits with leaded boots. Both of these were launched from boats and tethered by a cable and air hose.

Dive masks, snorkels, and SCUBA tanks changed all that. This gear made it possible for ordinary people of all walks to experience the creatures and scenery below the water with unbridled freedom of movement. Comfort and view were also unprecedented. Comfort came from the body being suspended in the water with no stress or strain on the neck, shoulders, or back. The only part of the body that required muscle use was in the legs for movement through the water by kicking. The view is up close and personal, with the lens of a mask inches from the users eyes and the water into which the user is viewing is against the outer surface of the lens. An arrangement that creates a secondary water level beneath the lens. A combination that creates an effect experienced by snorkelers and scuba divers in which objects below the surface appear twenty five times larger, making one feel more a part of the world below the water into which they view.

However, with all these advantages, problems with conventional mask and snorkel use occur. Problems for many that cause difficulty of use and discomfort or prevents others from using the devices all together. Prior art has not adequately addressed these problems or provided for the many of the advantages. Still others, in addressing the problems of both conventional snorkel gear and those of earlier prior art, created yet other problems of comfort and/or safety.

Users of conventional masks can experience condensation or fogging of the inside surface of the mask lens. Prior art of crafts and/or viewing devices incorporating a single transparent end wall at the bottom or hull side of these devices can not prevent water from being splashed onto the inside surface of the transparent pane or end wall. The collars and/or turrets embodied in these devices can also cause condensation or fogging of the inside surface from climatic changes or the users breath. Either of these conditions would require the user to return to shallow water or shore for removal. In the context of comfort, it is not addressed. Users must hold their heads up over the viewing area or device; straining the neck, shoulder, and back muscles or supporting themselves on their elbows. Both positions limit viewing time according to the physical condition of the user and with physical condition being relative to age, this precludes a large section of the population from using these inventions at all.

Later prior art addressed the aforementioned problems in-part. The embodiments incorporated in one was a specially designed craft where the top of the viewing area was molded to conform to the users face. Though comfort was addressed, it was neither complete nor singular in purpose. There is no padding around the facial port and the face placed over and into the viewing port was what kept extraneous water and light from the inside of the viewing area. Another invention addresses the problem of extraneous water and provides a measure of comfort. However, the viewing device being basically a transparent trapezoidal box that is heretically sealed with a centrally disposed interior, will form condensation on the inside of the viewing device with changes in the climate. The same problem experienced with conventional snorkel masks. Comfort in another invention was provided in the form of a cowl, but as the invention above is not singular in purpose. The cowl is crucial in the proper operation of the viewing device. Furthermore, people who are precluded from using a snorkel mask because of claustrophobia clearly are precluded from using this device.

With all things considered, (it the principal object of the) present invention

A) To provide a craft for viewing below the surface of the water through a viewing area that eliminates costly tooling for a viewing device.

B) To provide a craft with a viewing area that provides the advantages and resolves the disadvantages of snorkeling with mask and snorkel.

C) To provide a craft that singularly for no other purpose addresses comfort of the user.

D) To provide a craft where by the upper surface of the craft automatically positions the user in a posture that replicates that of conventional snorkel gear users.

E) To provide a craft that delivers a level of comfort that is not only unequal to prior art, but replicates that experienced by users of conventional snorkel gear by holding the neck and spine in alignment while comfortably, without confines, supports the head and body, removing all manner of strain from the neck, shoulders, arms, and back.

F) To provide a craft with an underwater viewing area that, by design, will not cause fatigue or discomfort that would be the factor in limiting ones viewing time.

G) To provide a craft with an open-aired, non-confining underwater viewing area that can be used by those who are otherwise precluded from using a conventional mask because of claustrophobia.

H) To provide a craft with an underwater viewing area that can be used by the vast majority including the young, old, and the physically challenged.

I) To provide an underwater viewing area within a craft that accomplishes the removal of extraneous water with a simple and automatic means.

J) To provide an underwater viewing area within a craft that through design, makes fogging and the forming of condensation on the interior or exterior of the viewing area a non-existent issue.

K) To provide an underwater viewing area that delivers the clarity and visual enhancement experienced with conventional snorkel masks.

L) To provide a craft that allows a user to not only lie prone and view below the surface of the water, but also lie transposed for relaxation or sunning.

Further objects and advantages of the invention is to provide a rigid, seamless said craft, with an underwater viewing area that requires no tooling by such means as blow or roto-molding, and/or an inflatable craft. Still further object and advantages will become apparent from a consideration of the ensuing description and drawings.

DRAWING FIGURES

REFERENCE NUMERALS IN DRAWINGS

99 Rigid Craft
99A Inflatable Craft
100 Upper Transparent Pane
100A Lower Transparent Pane
100B Deck of Viewing Area
102 Gutter
103 Deck of Rigid Craft
103A Deck of Inflatable Craft
104 Aft Scuppers/Vertical Vents
104A Forward Scuppers/Vertical Vents
106 Vertical Vents
107 Closeable Cap
108 Fluid Fill and Drain Vent
108A Alternate Fluid Fill and Drain Vent
110 Cup Holder Scuppers/Vertical Vent
112 Head Support of Rigid Craft
112A Head Support of Inflatable Craft
114 Cavity through Craft
116 Recessed Lip of Upper Perimeter Edges of Cavity
116A Recessed Lip of Lower Perimeter Edges of Cavity
117 Hull of Rigid Craft
118 Walls of Cavity in Rigid Craft
118A Walls of Cavity in Inflatable Craft
118B Centrally Recessed Pocket within Aft Wall of Cavity
122 Threaded Sleeve Inserts
124 Retainers
126 Fasteners
127 Picture Frame Flange
128 PVC Flange Laminate
130 Outer Perimeter Air Chamber
130A Lateral Air Chambers of Deck
130B Interior Air Chamber between Deck and Bow of Outer Air Chamber
132 Recessed Hull Area around Perimeter of Lower Transparent Pane
133 Neck and Spine Alignment
134 Human Figure
135 Male Snap Stud
136 Female Snap Receptacle
137 Snap Tabs
138 Gasket

DESCRIPTION

Figure 1:
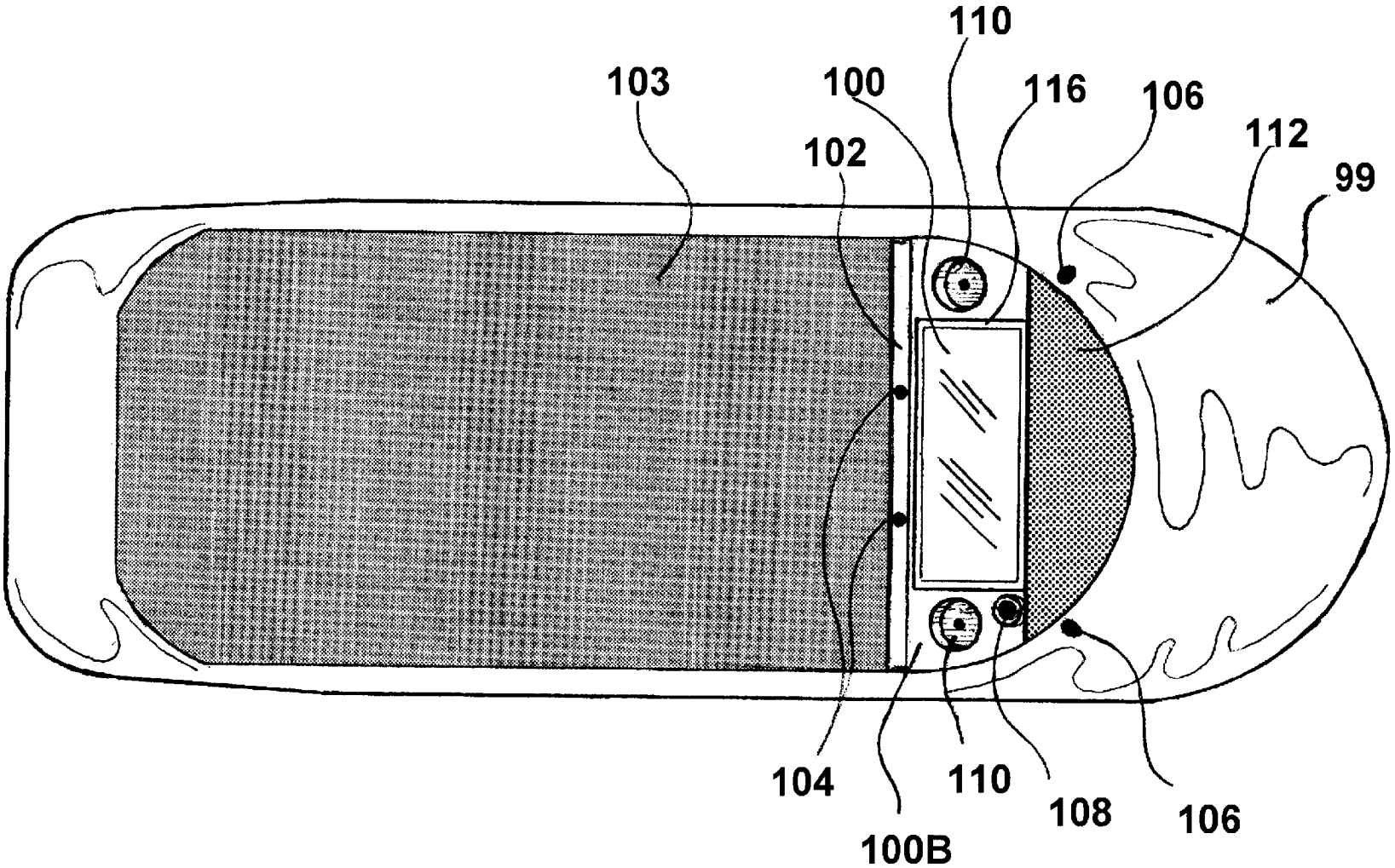
FIG. 1 Shows a top view of a rigid craft and underwater viewing area, top surface.

FIGS. 1, 1A, 2, 2A, 4, 4A, and 4B—Preferred Embodiments A preferred embodiment of a rigid craft with an underwater viewing area of the present invention is illustrated in FIG. 1. A top view shows the layout of the upper surface of the craft. Beginning at the bow, a cushioned head support FIG. 112 is shown with vertical vents FIG. 106 either side that extend through the depth of the craft FIG. 99. Immediately aft of the head support FIG. 112 is a viewing area. A transparent material comprises FIG. 100, the upper surface of the viewing area herein known as, upper transparent pane. Said upper most transparent pane FIG. 100 has to either side a pair of combination cup holders and vertical vents FIG. 110. Shown located on the starboard side of said upper transparent pane FIG. 100, near the base of said head support FIG. 112, is a fluid fill and drain vent FIG. 108, and a recloseable cap FIG. 107, not shown. Immediately behind the viewing areas upper transparent pane, is a gutter FIG. 102 extending beam to beam and a set of scuppers FIG. 104. The area immediately to port and starboard of said upper transparent pane FIG. 100 is horizontal with said pane and extends to both port and starboard beam comprising a viewing deck FIG. 100B. Aft of said viewing deck FIG. 100B is a padded deck FIG. 103. Said deck supports the upper body of a user. Padded deck FIG. 103 and head support FIG. 112 are two aspects of a craft FIG. 99 that addresses comfort with singular purpose. Said rigid craft of the present invention are manufactured by blow molding or roto-molded, one-piece seamless construction. Other means of comfort will be obvious in following drawings.

Figure 1A:
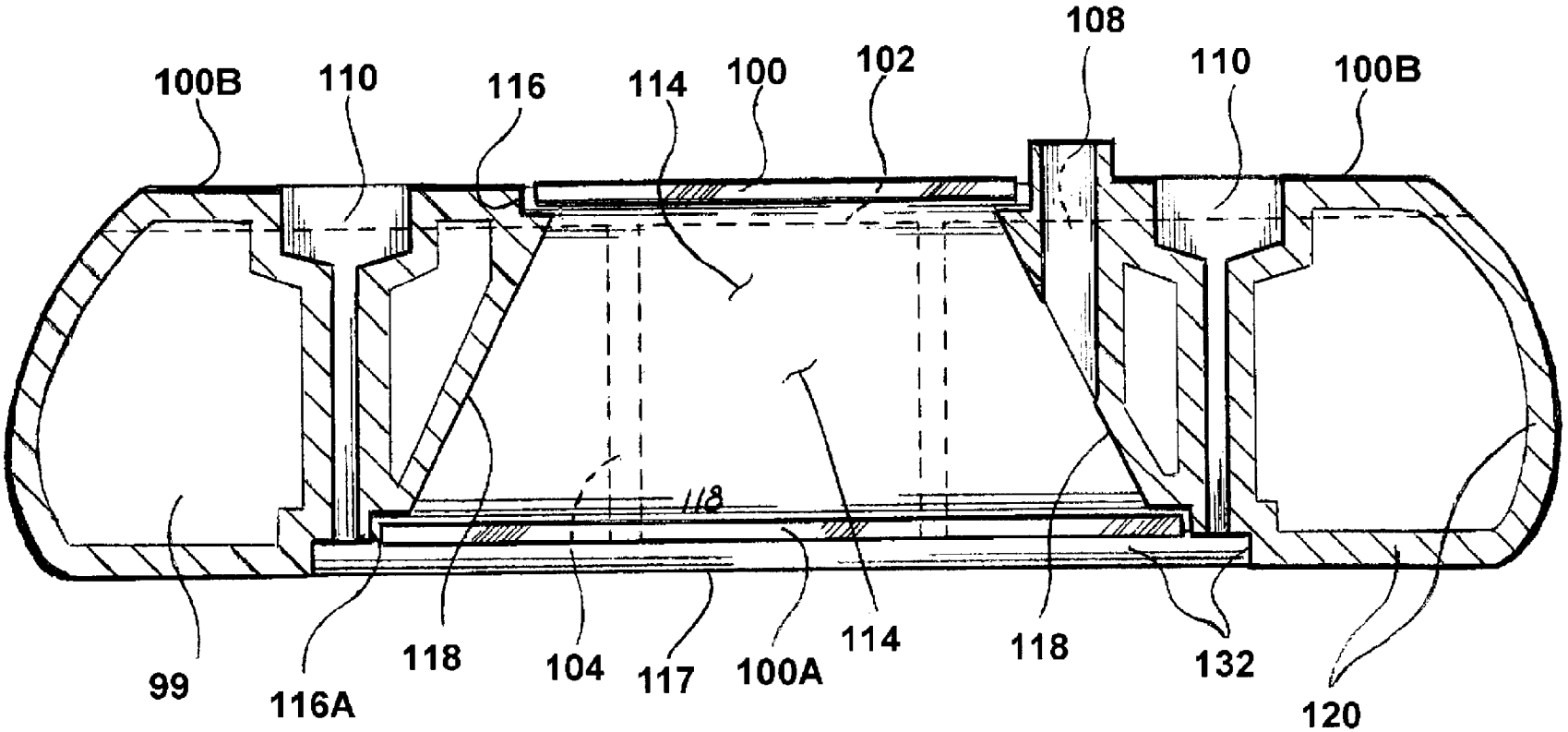
FIG. 1A Shows a cut-away, isometric view from bow of a rigid craft.

A cut-away, isometric view FIG. 1A, seen from the bow of a rigid craft FIG. 99, detail such components as a viewing deck FIG. 100B as seen in FIG. 1, and components below an upper transparent pane FIG. 100 as seen in FIG. 1 that make up the viewing area. The viewing area is comprised of an upper transparent pane FIG. 100, and a lower transparent material, hereafter referred to as lower transparent pane FIG. 100A, and a walled FIG. 118 cavity FIG. 114 extending vertically through said craft FIG. 99 as seen in FIG. 1A, that transcends the depth of said craft from top surface of said viewing deck FIG. 100B to the lower surface of a hull FIG. 117 in a trapezoidal configuration. The upper opening of said cavity has a recessed lip FIG. 116 around the perimeter edges of said cavity and said cavity opening through the lower surface of said hull FIG. 117 also possess a recessed lip FIG. 116A around the perimeter edges of said cavity. The perimeter shape of said upper transparent pane FIG. 100 matches that of said upper recessed lip of said cavity and is of adequate dimension to fit securely into and upon said upper recessed lip. The perimeter shape of said lower transparent pane FIG. 100A matches that of said lower recessed lip of said cavity and is of adequate dimension to fit securely into and upon said lower recessed lip. Said upper and lower transparent panes can be of plexiglass, PVC, polycarbonate, tempered glass, or any transparent material of adequate clarity. Said upper and lower transparent panes are sealed in place within said upper and lower recessed area by a simple chemical bonding agent or adhesive, such as but not limited to epoxy, LIFESEAL™, a polyurethane silicone compound, or 3M 5200™, a Dow Chemical product, forming a sealed watertight area within a centrally hollow area of said cavity. A fluid fill and drain vent FIG. 108 is shown incorporated integrally into said craft, out of the way of a users view below the water. It is through said vent that said cavity can be filled with a transparent liquid, such as water, until all air is removed from said cavity. Said upper and lower panes, encapsulating the inner space of said cavity and filling of said cavity with a transparent liquid, comprises a simple straight forward underwater viewing area that requires no tooling for molds. In other words, no device, contraption, or costly fabrication. Preferred embodiments shown in FIG. 1A are a combination cup holders and vertical vents FIG. 110. Said vents extend from the bottoms of said cup holders, downwardly through said craft into a hull recessed area FIG. 132 that expands outwardly around said lower transparent pane perimeter. Said vents FIG. 110 are but two means by which trapped air below said lower transparent pane is removed when said craft is placed into the water. A gutter FIG. 102 from which a set of scuppers FIG. 104 extend downwardly through said craft are shown in FIG. 1A also. Said gutter and said scuppers, being immediately aft of said upper transparent pane, provide for easy, automatic removal of extraneous water from the top surface of said upper transparent pane.

Figure 2:
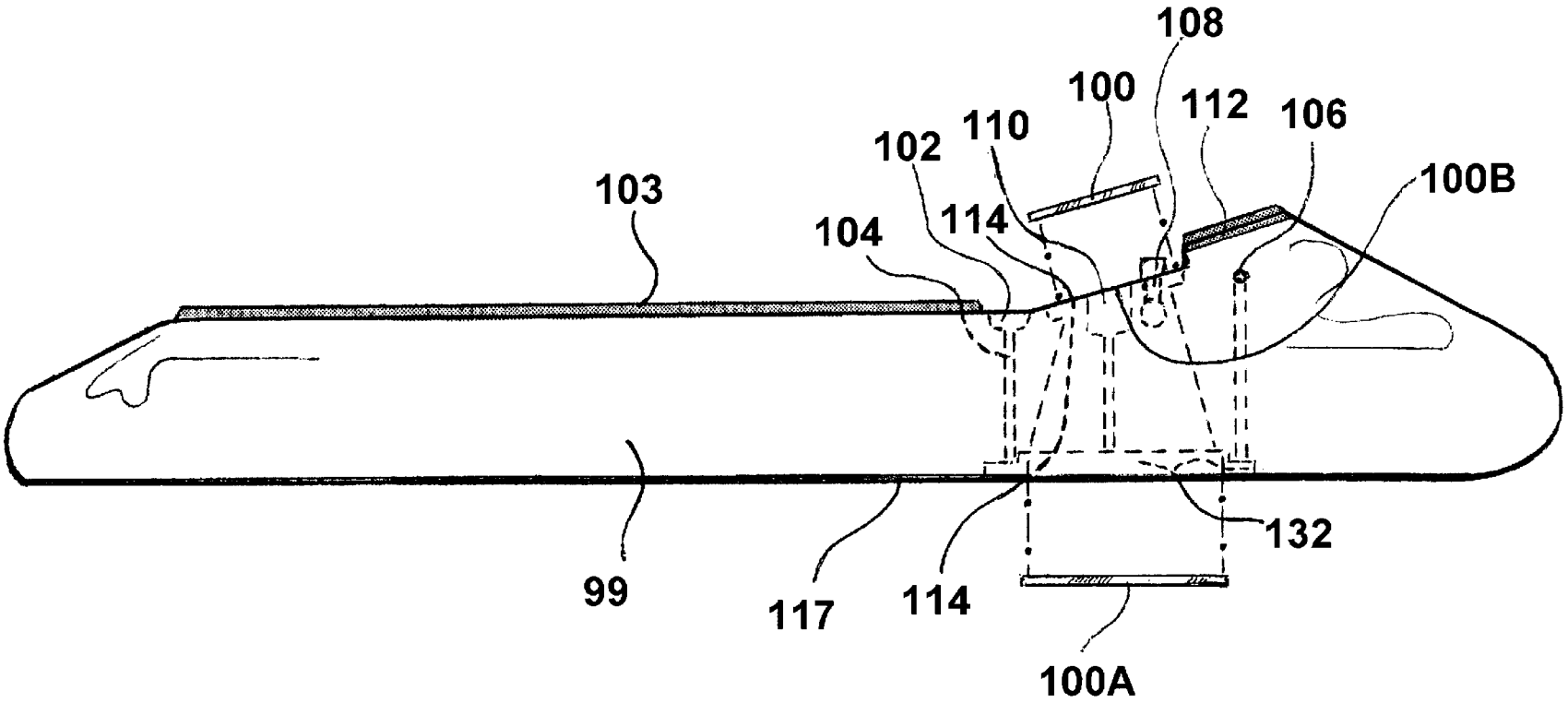
FIG. 2 Shows a side, isometric view of a rigid craft.

FIG. 2 is a side, isometric exploded view of a rigid craft FIG. 99. A vertical vent FIG. 106 is shown to starboard of a head support FIG. 112. A second said vertical vent is positioned on the port side, not shown. Said vertical vents extend from the upper surface of said craft downwardly through the craft into said recessed area, FIG. 132. Said vertical vents in conjunction with said combination cup holder verticals FIG. 1A remove air that may become trapped below said craft, inhibiting the view below the water. An upper transparent pane FIG. 100 and a lower transparent pane FIG. 100A are shown in an exploded view indicating placement of said upper and lower transparent panes. It is the preferred embodiment of FIG. 2 in which said upper transparent pane is on a grade slanted aft in conjunction. This embodiment provides for splashed or otherwise extraneous water to drain off automatically into a gutter FIG. 102 then down a set of scuppers FIG. 104, one shown, away from said viewing deck and upper transparent pane. A craft FIG. 99 of FIG. 2 with a padded head support FIG. 112, placed at a height relative to a padded deck FIG. 103 allows for the face of a user to rest comfortably over said upper transparent pane of viewing area without making contact. Further advantages of comfort will be obvious in following drawing.

Figure 2A:
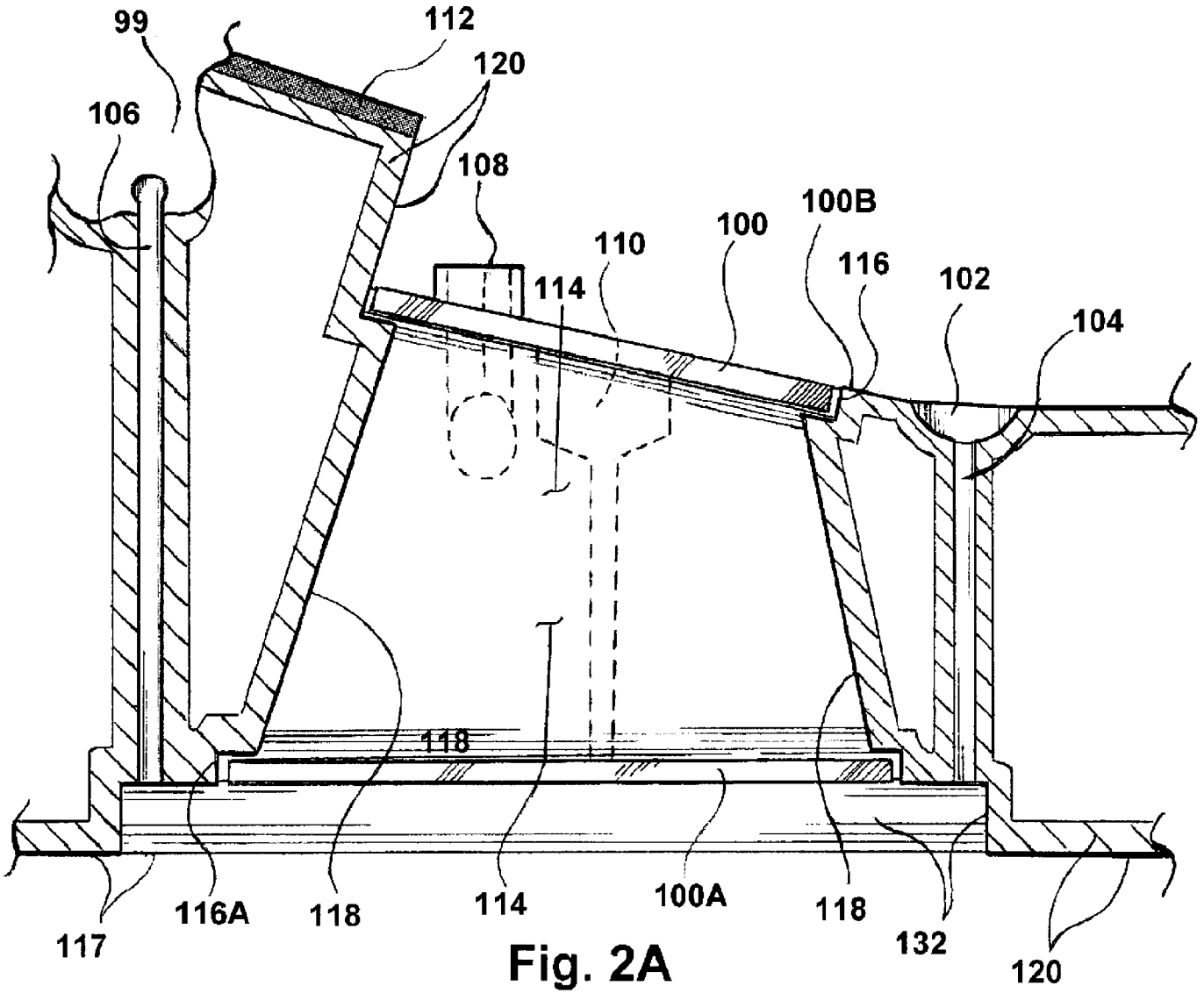
FIG. 2A Shows a cut-away, isometric side view of underwater viewing area within a rigid craft.

FIG. 2A is an exploded, cut-away, side detail of an underwater viewing area in a rigid craft with an upper transparent pane FIG. 100 slanted. Shown is a fluid fill and drain vent FIG. 108 integrated into a rigid craft FIG. 99. A walled FIG. 118 cavity FIG. 114 through said craft and centered within said craft is directly below a head support FIG. 112. The upper perimeter shape of said cavity can be, but not limited to, rectangular or oval in shape and of sufficient dimensions to provide a wide field of view. In any case, said cavity of FIG. 2A moves downwardly and outwardly in a trapezoidal configuration to and through hull FIG. 117. A slanted viewing deck FIG. 100B is shown on equal plane with the upper opening of said cavity. A recessed lip FIG. 116 around said cavity upper perimeter edges providing a ledge on to which an upper transparent pane FIG. 100, of equal shape and dimension, may rest into and upon covering said cavity opening. Accordingly, a lower recessed lip FIG. 116A providing the same function as said upper recessed lip, allowing for a lower transparent pane to fit securely into and upon, covering completely said cavity lower opening. As previously explained, said transparent panes can be chemically bonded in place to be watertight or simply snapped into place over a waterproof gasket, not shown, by means of, but not limited to, snap tabs molded in with said craft. When said cavity's centrally void interior, between said upper and lower transparent panes, is filled with a transparent liquid, an underwater viewing area of the present invention is created within said rigid craft. Further embodiments of FIG. 2A shows a port side vertical vent FIG. 106, starboard side not shown. Said vents extend from the top side of a rigid craft FIG. 99 through said craft into a recessed hull area FIG. 132 around the perimeter of said lower transparent pane. Said vertical vents, in conjunction with combination cup holders and vertical vents FIG. 110 that also extend through said craft into said recessed hull area, remove air bubbles that may become trapped beneath said lower transparent pane. A gutter FIG. 102 is molded into said craft directly aft of said upper viewing pane. Said gutter may be the same width athwartships of said upper transparent pane or extend the full beam of said craft, as shown in FIG. 1 and FIG. 1A. A set of scuppers FIG. 104 extends from said gutter downwardly through craft into said recessed hull area. Said scuppers and gutter receives extraneous water that automatically runs off said slanted upper transparent pane FIG. 100. Said recessed hull area FIG. 132 functions primarily to protect the outer surface of said lower transparent pane FIG. 100A from damage whether in or out of the water. The filling of said cavity, with a transparent liquid displacing any and all air from within said cavity, not only eliminates any problem with condensation or fogging of the inside or outside surfaces of said upper and lower transparent panes, but enhances the view below the water by making objects below the surface appear twenty five times larger. Replicating the same twenty five percent magnification experienced with conventional snorkel and SCUBA masks.

Figure 2B:
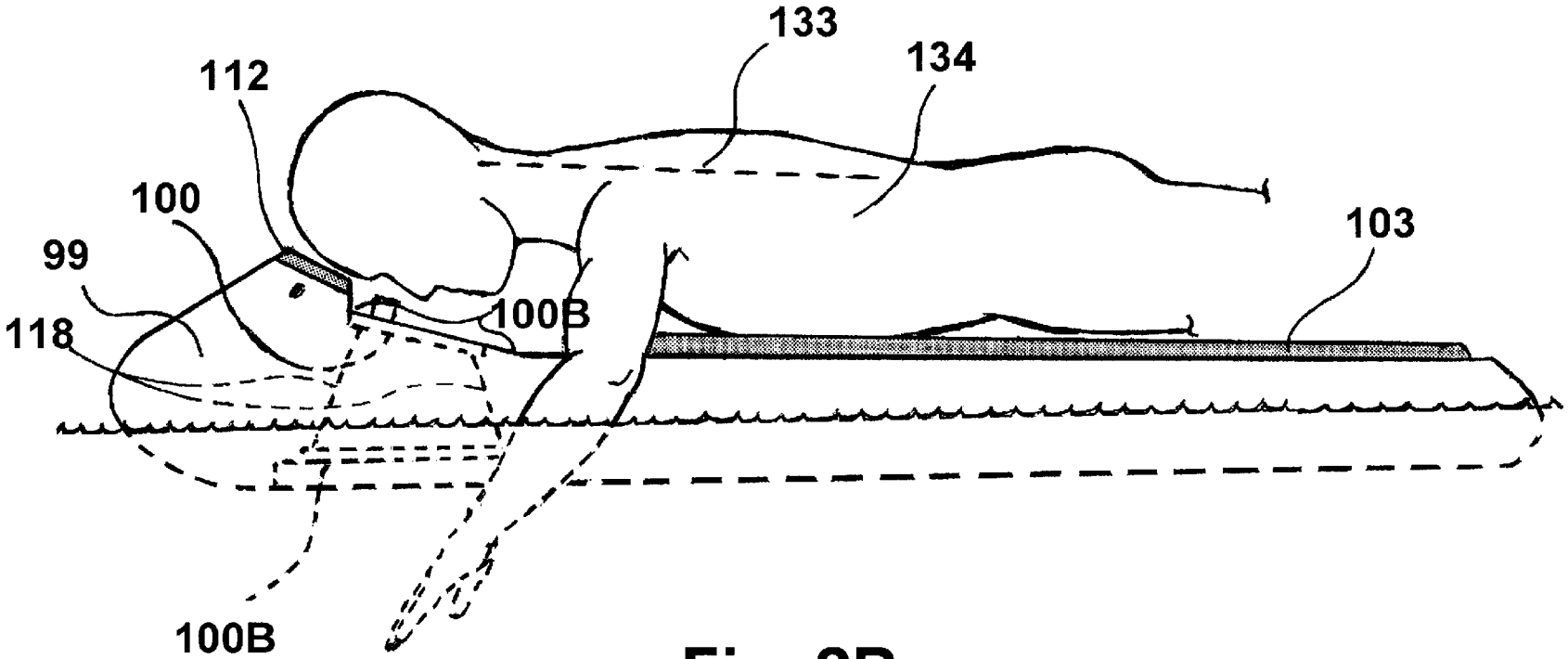
FIG. 2B Shows a side view of a rigid craft with human figure upon craft.

In FIG. 2B a side view of rigid craft FIG. 99 with a slanted viewing deck FIG. 100B and resulting slanted upper transparent pane FIG. 100. A human shape FIG. 134 is also shown representing body position upon said craft herein known as user. An isometric side representation shows a pair of inner cavity walls FIG. 118, that define the shape and position of said cavity relative to the head and face of a user. The upper transparent pane FIG. 100 and lower transparent pane FIG. 100B are in their respective places covering and sealing watertight the upper and lower extremity of said cavity. It is with said drawing that one skilled in the art can see, in perspective, the advantages addressed in the area of comfort and ease of use. Firstly, the head of said user is supported comfortably upon a head support FIG. 112 and the body of said user reclines upon a padded deck FIG. 103. The height of said head support, relative to said deck, aligns both neck and spine FIG. 133 of said user and provides total body support; eliminating all stress or strain from a users neck, shoulders, and back. Total body support and alignment that replicates that of a snorkeler using conventional gear. A non-conforming, open-air space below and around said face and head of said user, allows cool, unrestricted breathing and unblocked peripheral vision. An embodiment that not only makes use of the present invention possible for those who suffer from claustrophobia but also embraces a measure of safety when used around other swimmers and more especially boat traffic. Note the upper arms of said user move slightly outwardly and downwardly in a relaxed, natural manner, embracing said craft. Allowing for range of motion, like that of a natural swimming motion, when paddling.

Figure 2C:
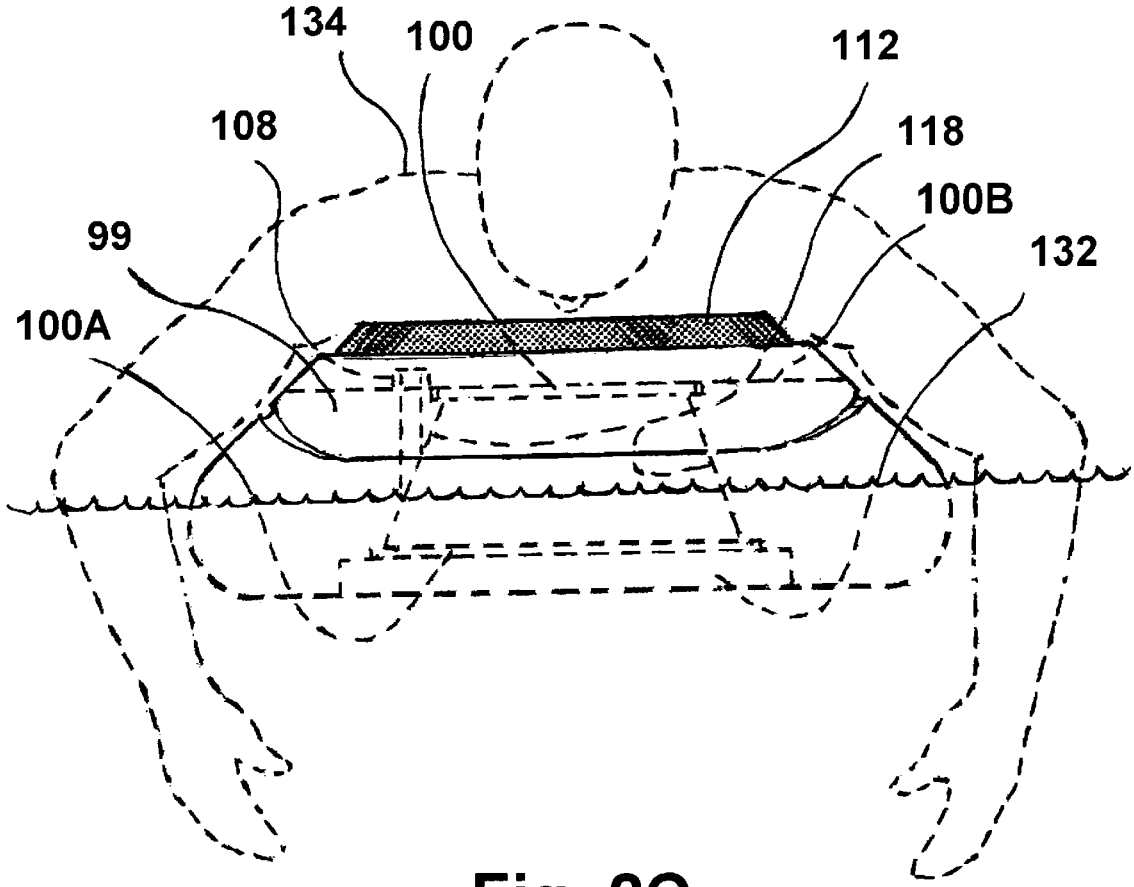
FIG. 2C Shows a frontal, isometric view of a rigid craft with human figure upon craft.

FIG. 2C shows a front view of said craft FIG. 99 with a human figure FIG. 134 in correct position upon said craft. Human figure will herein be referred to as user. The users head is reposed upon said head support FIG. 112. The arms of said user are held, as previously mentioned, outwardly and downwardly along the sides of said craft FIG. 99. The shoulders and arms of said user are totally reposed and supported by said craft FIG. 99. An isometric illustration shows a front view of said crafts underwater viewing area comprised of said upper transparent pane FIG. 100, said lower transparent pane FIG. 100A, said transparent fill and drain vent FIG. 108, and said centrally hollow cavity through said craft indicated by said inner walls FIG. 118. Shown also is said recessed hull area FIG. 132 and said viewing deck FIG. 100B. The length of said craft can be, but not limited to, a full body length or a shorter length. Allowing the use of fins for propulsion.

Figure 3:
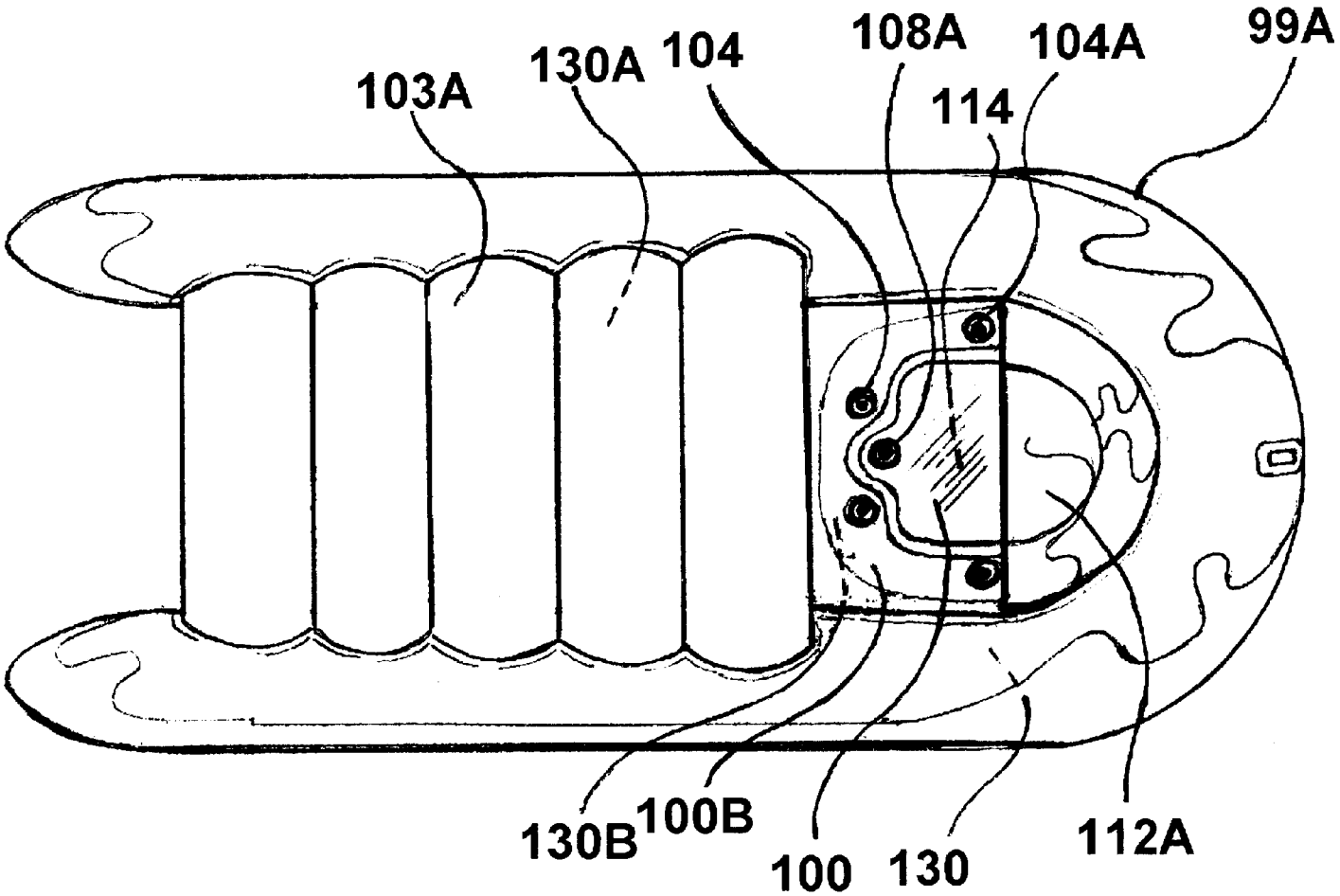
FIG. 3 Shows a top view of an inflatable craft with an underwater viewing area.

A further preferred embodiment of the present invent is shown in FIG. 3. A top view of an inflatable craft with an underwater viewing area. A craft FIG. 99A is comprised of a horseshoe shaped outer air chamber FIG. 130 with a lateral air chamber FIG. 130A of said craft. An inner air chamber FIG. 130B as shown in the drawing is between a deck FIG. 103A and a head support FIG. 112A and extends, beam to beam, to said outer perimeter air chamber, comprising a viewing deck FIG. 100B. Centered in said viewing deck FIG. 100B and immediately aft of said head support FIG. 112A is an upper transparent material, herein know as pane. The transparent pane in this instance is acrylic or PVC. Said upper transparent pane covers the top opening of a walled, centrally hollow cavity FIG. 114 that extends through the full depth of said craft. A vent FIG. 108A is shown within said upper pane for filling and draining of said cavity with a transparent liquid. Shown to each side of said upper transparent pane near said head support FIG. 112A is a set of forward scuppers FIG. 104A that serve also as vertical vents. Aft of said upper transparent pane is a set of aft scuppers FIG. 104 that serve also as vertical vents. Said scuppers remove splashed or otherwise extraneous water from said viewing deck FIG. 100B and said upper transparent pane FIG. 100 that would otherwise negate the view below the water.

Figure 3A:
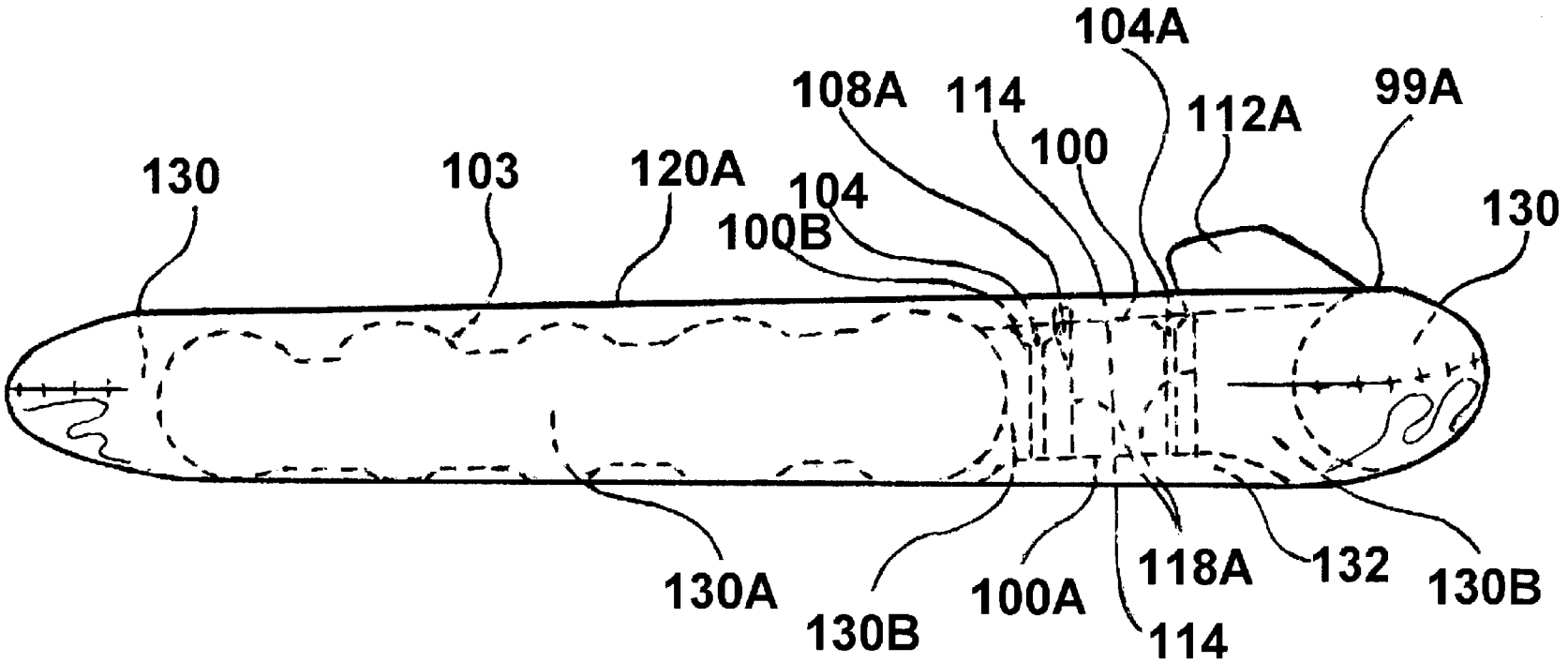
FIG. 3A Shows a side, isometric view of an inflatable craft with an underwater viewing area.

FIG. 3A shows an isometric side view of said inflatable craft FIG. 99A. Said inner chambers FIG. 130A that comprise said deck FIG. 103A are seen to reduce in diameter as they move aft. This places said outer air chamber FIG. 130A slightly higher than said deck FIG. 103A creating a cradling effect for the body of a user and more importantly automatically centers the user on the craft and holds them there. This feature is especially important for young children. Watercraft, regardless of its material of construction, pose problems for young children much like that of riding a bike. When a child boards a watercraft, he must be centered; otherwise, the craft will tilt causing the child to slide off. The same will happen if the child moves off-center after they have successfully boarded the craft. This could be a dangerous situation if the child has maneuvered craft into water depth beyond their capabilities. A second air chamber FIG. 130B is shown between said air chamber FIG. 130A and bow of said outer chamber FIG. 130. The top exterior portion of said inner air chamber FIG. 130B forms a viewing deck FIG. 100B that is slanted to aft. Within said inner chamber FIG. 130B is formed a walled FIG. 118A centrally hollow cavity FIG. 114 extending vertically through the expanse of said craft FIG. 99A. A pair of inner cavity walls FIG. 118A is shown, port and starboard walls are not shown. Said inner cavity walls FIG. 118A show a side view of said cavity shape, which is a perpendicular, box shape. In a preferred embodiment, its shape would be trapezoidal, shown in following drawing. The upper extremity or opening of said cavity FIG. 114 extending through said viewing deck FIG. 100B is covered and seal by an upper transparent pane FIG. 100. The lower extremity or opening of said cavity FIG. 114 is covered and sealed by a lower transparent pane FIG. 100A. A vent FIG. 108A for filling of said cavity FIG. 114 with a transparent liquid such as water. The above embodiments comprise an underwater viewing area. A recessed area FIG. 132 below said lower transparent pane FIG. 100A extending beyond said lower pane FIG. 100A fore and aft, as shown. Said recessed area FIG. 132 extends also to port and starboard, not shown, of said lower transparent pane FIG. 100A. Said recessed area FIG. 132 serves to protect said lower transparent pane from damage. A starboard side forward scupper and vertical vent FIG. 104A is shown extending from said viewing deck FIG. 100B downwardly through said craft FIG. 99A into said recessed area FIG. 132, port side not shown. Said scupper vents can serve to remove extraneous water from said viewing deck FIG. 100B but exist primarily for removal of air bubbles that may become trapped below said lower transparent pane FIG. 100A. Said viewing deck FIG. 100B and the upper transparent pane FIG. 100, in combination, slant aft moving extraneous water down into a set of scuppers FIG. 104, port scupper not shown. Said scuppers FIG. 104 extend downwardly through said craft FIG. 99A into said recessed area FIG. 132. A head support FIG. 112A is also shown.

Figure 3B:
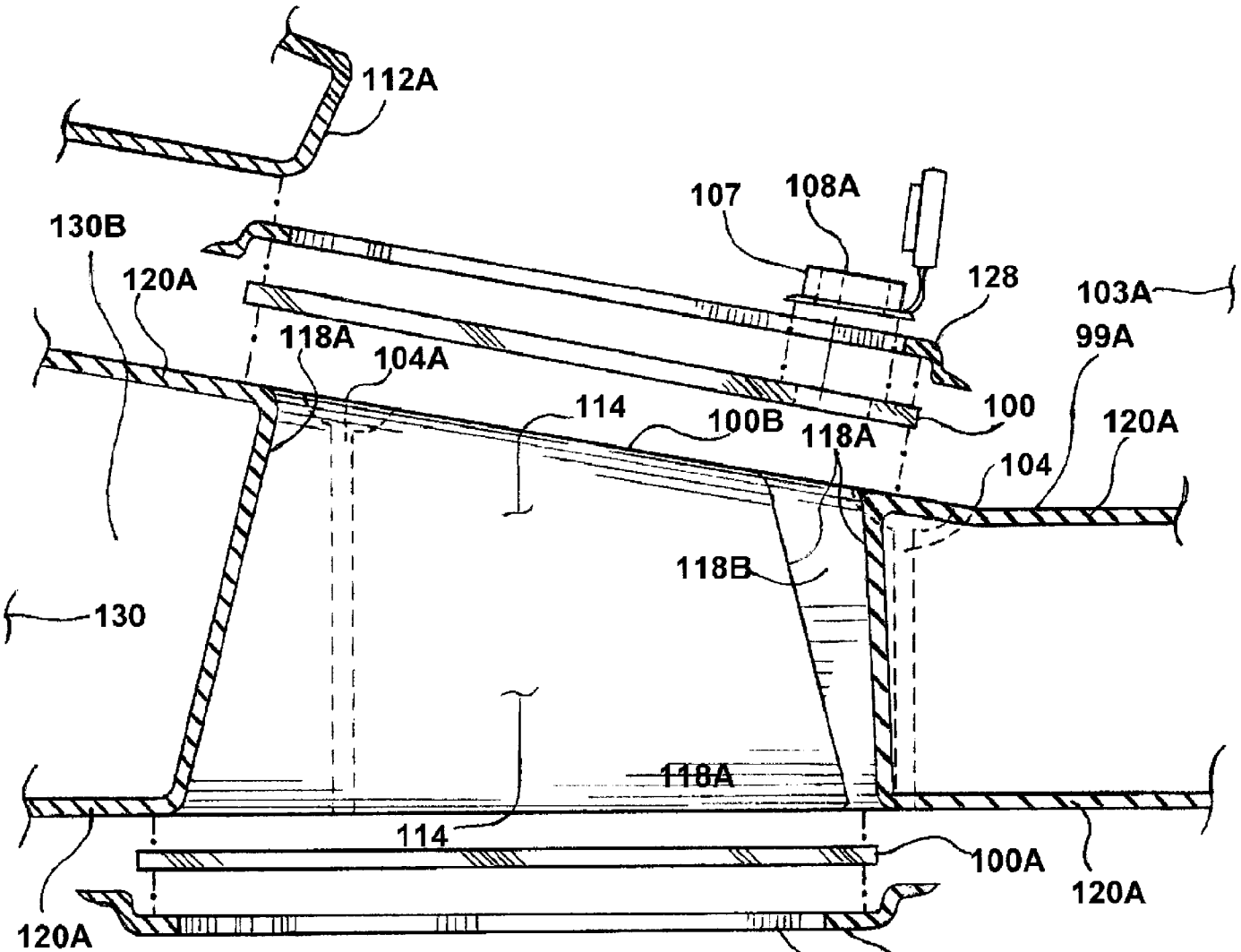
FIG. 3B Shows a cut-away, exploded side view of an underwater viewing area within an inflatable craft.

In FIG. 3B, a cut-away, isometric side view of said interior air chamber FIG. 130B which occupies the area between said outer air chamber FIG. 130, and from said deck FIG. 103A to bow of said outer air chamber FIG. 130. Detailed in this illustration is said viewing area consisting of said cavity FIG. 114, an upper transparent pane FIG. 100, a lower transparent pane FIG. 100A, and a centrally hollow cavity FIG. 114 between said upper and lower transparent pane. Said upper transparent and lower transparent panes are sealed watertight over the upper and lower extremities of said cavity by means of, but not limited to, a PVC flange lamination FIG. 128 electrically welded. A hole or vent FIG. 108A within said upper transparent pane for the filling and draining of a transparent liquid with a closeable cap FIG. 107 is centered within the aft perimeter expansion of said upper transparent pane FIG. 100, above a recessed pocket FIG. 118B within said aft wall FIG. 118A of said cavity FIG. 114. This keeps said fill and drain vent FIG. 108A from obstructing the view below the water. Said head support FIG. 112A is a separate air chamber and is electrically welded adjacent to the forward edge of said upper transparent pane FIG. 100 to place a users eyes centrally over said upper transparent pane. Said viewing deck FIG. 100B is slanted aft on plane with said upper transparent pane FIG. 100 to evacuate any extraneous water downwardly from the surface of said upper transparent pane into a set of scuppers FIG. 104. Port side scupper not shown. Said scuppers FIG. 104 in an inflatable craft FIG. 99A function as those in a rigid craft FIG. 99. A second set of forward scuppers FIG. 104A are shown aft of said head support FIG. 112A. Port side scupper not shown. These scuppers, though they can remove extraneous water, serve also to remove air that may become trapped below said lower transparent pane FIG. 100A. An inflatable craft with an underwater viewing area possess all the advantages of a rigid craft with an underwater viewing area. Perhaps more in the way of comfort due to its type of construction.

A means of viewing below the water that is trouble free, simple in design, inexpensive, crystal clear, in focus and magnified, with a broad field of view, incorporated integrally into a craft that addresses all points of comfort with singular purpose, makes for consideration of the advantages, of the present invention over that of prior art obvious.

Figure 4:
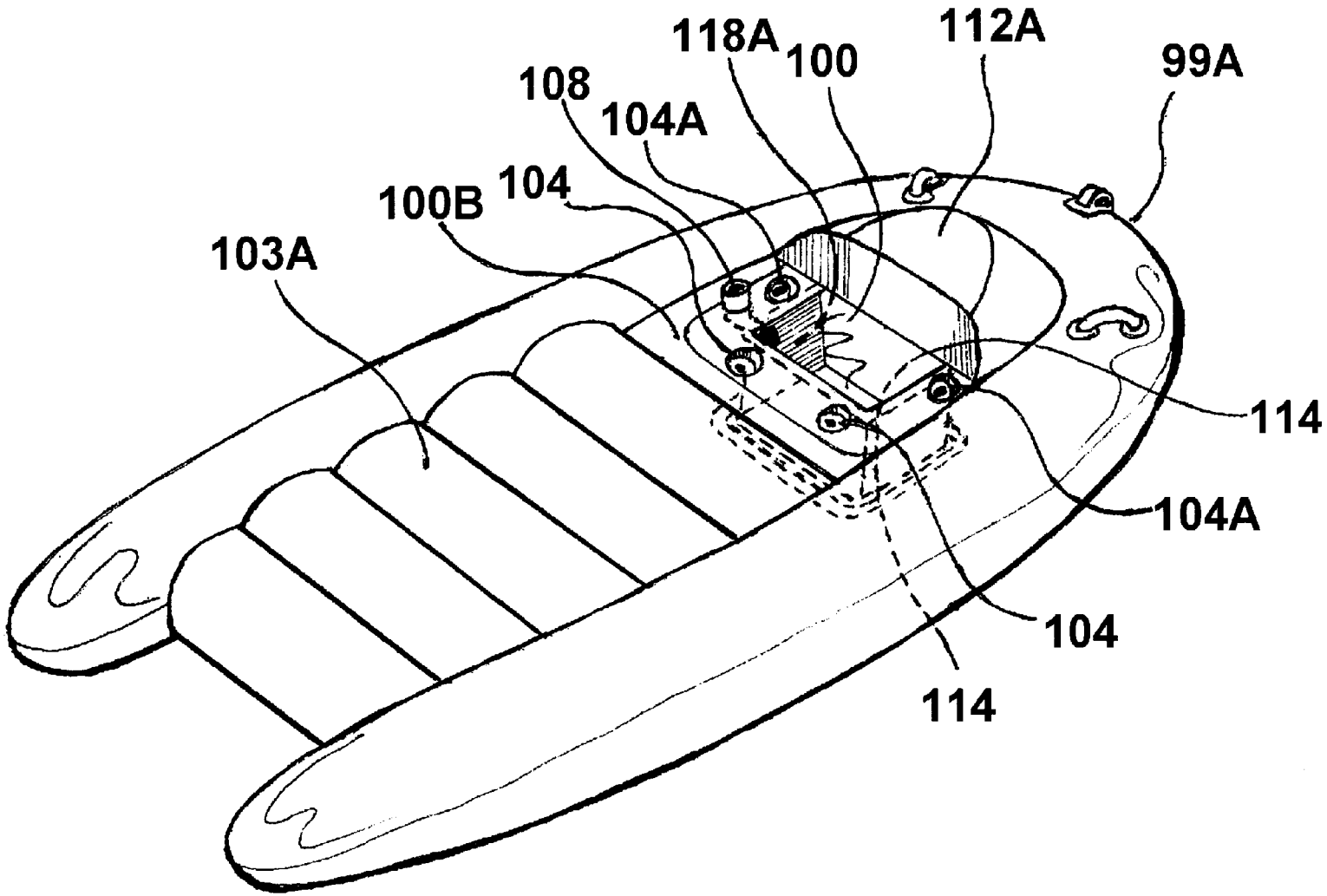
FIG. 4 Shows a perspective top view of an inflatable craft.
Figure 4A:
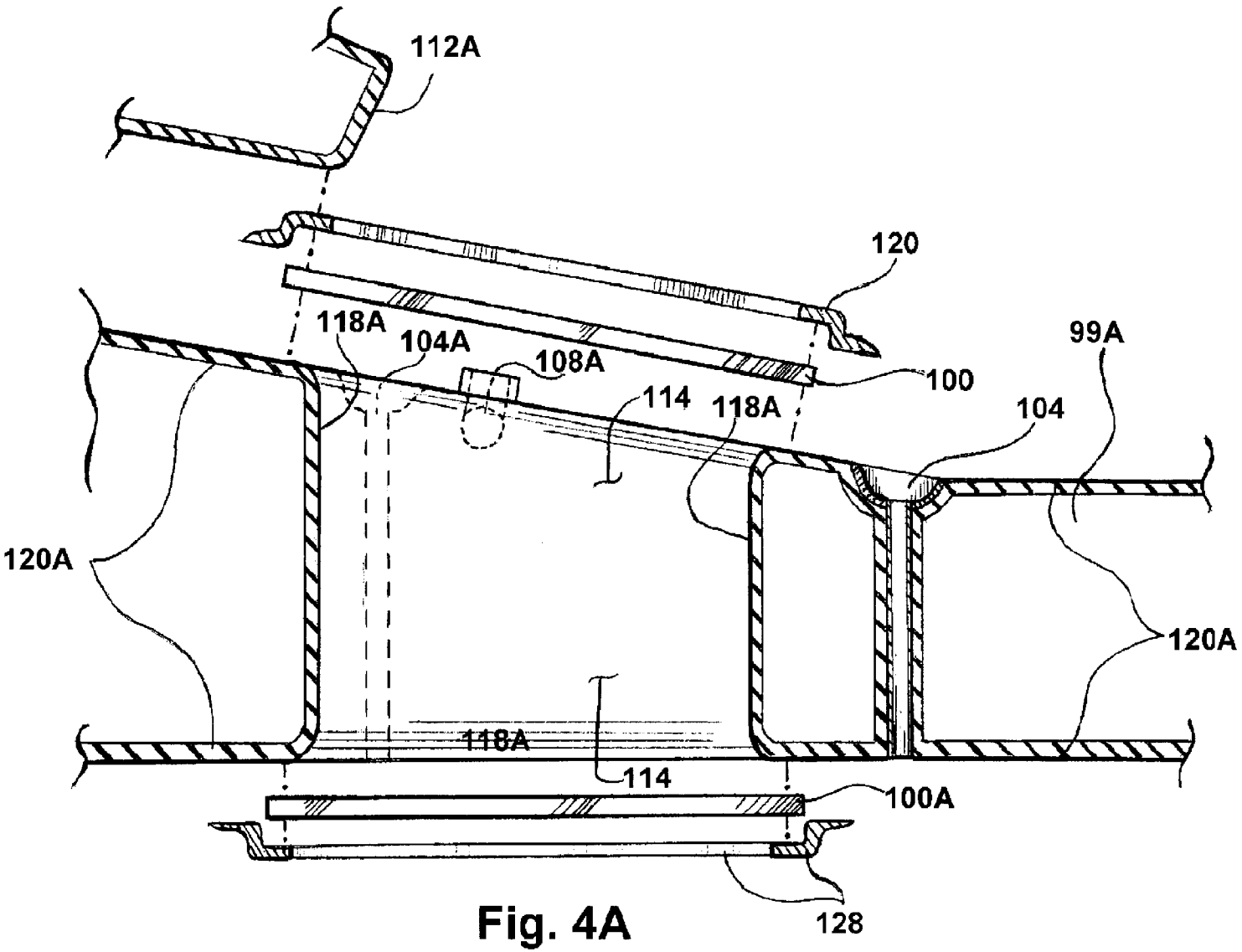
FIG. 4A Shows a cut-away, exploded side view of an underwater viewing area in an inflatable craft.

FIGS. 4 and 4A—Alternative Embodiments

In accordance with object and advantages of the present invention, alternative embodiments are shown in FIG. 4. A top perspective view of an inflatable craft FIG. 99A is shown. Said craft possesses all the embodiments of FIG. 3 and other previous drawings except for an upper transparent pane FIG. 100 and the location of an upper vent FIG. 108 for filling and draining of a transparent liquid. Said upper transparent pane has a straight aft edge and does not have a vent within it. A vent FIG. 108 for filling and draining of a transparent liquid is an integral part of the craft located to one side of said upper transparent pane FIG. 100. Said vent FIG. 108 is a tube extending from the upper surface of a viewing deck FIG. 100B downwardly and exiting into the upper portion of an inner wall FIG. 118A of a cavity FIG. 114 that extends vertically through the depth of said craft FIG. 99A, illustrated in an isometric view. A deck, FIG. 103A is shown as well as a head support FIG. 112.

FIG. 4A, possessing the object and advantages of the present invention, shows a cutaway, exploded side view of an underwater viewing area within an inflatable craft FIG. 99A. The embodiments of previous drawings of an inflatable craft are found in FIG. 4A except for a vent, FIG. 108A, for the filling and draining of a transparent liquid. Said vent, FIG. 108A, is an integral part of the craft. A cavity FIG. 114 is shown with vertical walls FIG. 118A rather than a trapezoidal shape. An upper transparent pane FIG. 100, and a lower transparent pane, FIG. 100A, in conjunction with a cavity, FIG. 114, through said craft FIG. 99A may be larger in width across the beam of said craft FIG. 99A. This increase would be such as to equal the interior volume of said cavity FIG. 114 between said upper transparent pane, FIG. 100, and lower transparent pane of a trapezoidal shape. Providing a wide field of view below the surface of the water.

Figure 4B:
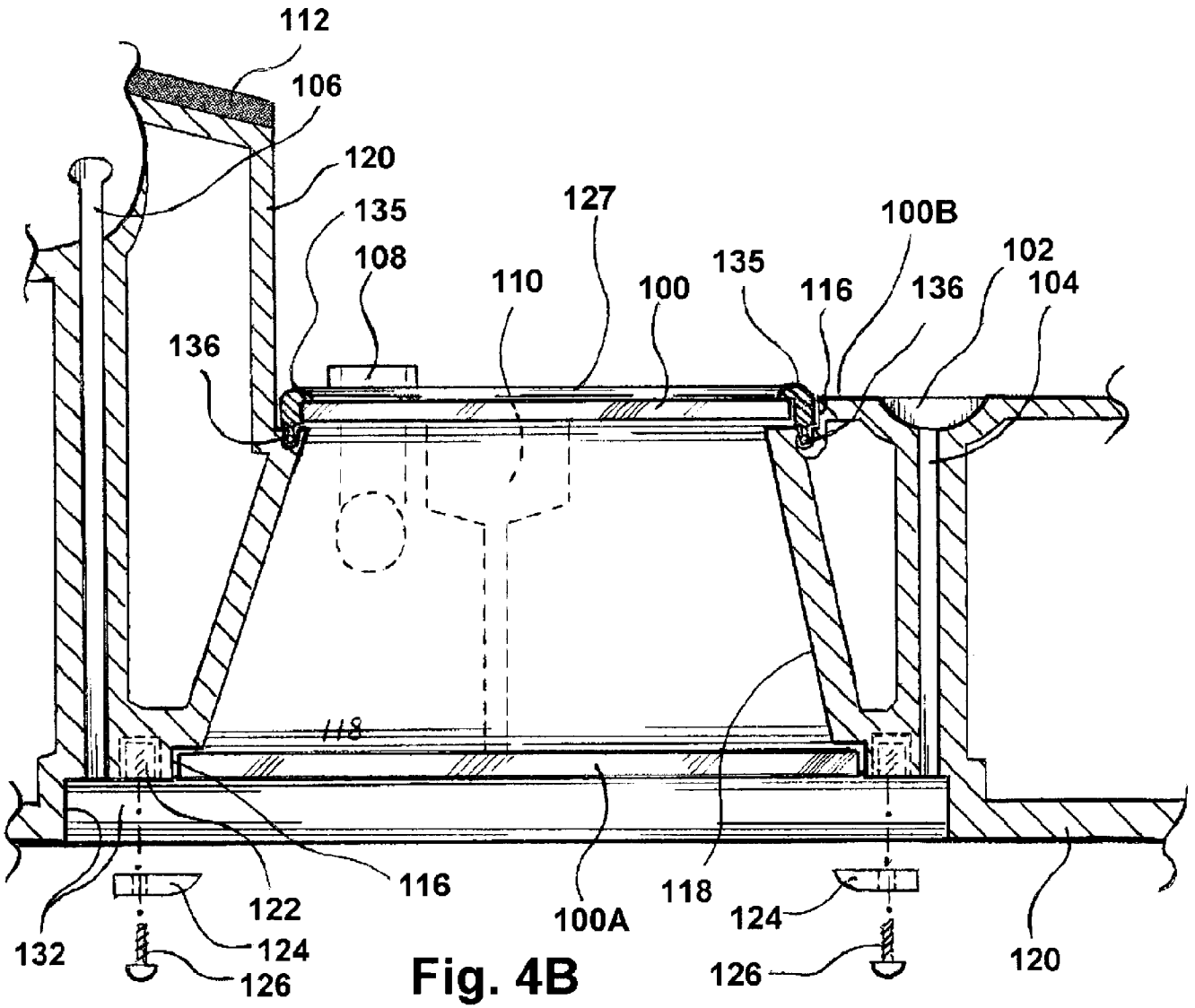
FIG. 4B Shows a cut-away side view of alternate viewing area embodiment.

FIG. 4B possessing all the object and advantages of the present invention as illustrated in previous drawings, shows a side cut-away view of an underwater viewing area of a rigid craft illustrating alternative means of securing said upper and lower transparent panes in place over the upper and lower vertical extremities of said cavity without modifying or altering said transparent panes to facilitate said attachments. Two such means are illustrated in said drawing FIG. 4B. Described first are threaded fasteners, FIG. 126, which extend through in combination with retaining devices FIG. 124. Said fasteners FIG. 126, in combination with said retaining devices, are screwed into said craft, within said hull recessed area FIG. 132, around and adjacent to the immediate perimeter of said transparent panes. Said retaining devices are of sufficient size to overlap the edge of said lower transparent pane securing said pane within said recessed lip of said, cavities upper and lower perimeters. The number of said fasteners FIG. 126 and retaining clips FIG. 124 used could be two or more. Said fasteners, clips, and threaded sleeves could be made of any material, such as plastic or stainless steel. Said retaining devices could be, but not limited to, ordinary washers. Said fasteners, not shown, could possess heads of sufficient diameter to overlap upper and lower transparent panes perimeter edges.

Said fasteners, not shown, could be of a button or stud nature, male or female, and snapped into place via mating receptacles, male or female, molded into said craft around the adjacent perimeters of said upper and lower pane FIG. 100 and FIG. 100A, securing said panes. Said means of securing said upper and lower transparent panes in place could be provided for with a rigid picture frame type flange FIG. 127 being of a material such as, but not limited to, plastic. Said flange could possess attachment points such as, but not limited to, male snap studs FIG. 135 that mate with female snap receptacles FIG. 136 around and adjacent to said upper and lower transparent panes which are molded into the craft allowing said flange to snap securely in place with the inside perimeter edges of said flange overlapping said upper and lower transparent panes, thus holding said panes captive. Said flange and previously described means of attachment of said upper and lower panes could be utilized in conjunction said sealants, caulks, or adhesives to achieve a watertight seal or a gasket of waterproof material such as, but not limited to, neoprene could be used in place of a chemical type of bond. Many methods exist other than the aforementioned by which said panes are attached to their said locations. The preferred method of the present invention is that which is the most effective and or cost effective. Shown also is a viewing area comprising said viewing deck FIG. 100B in combination with said upper transparent pane FIG. 100 that is horizontal.

Operation

When the craft is launched, with the viewing area filled with a transparent liquid, the lower transparent pane of the craft and the recessed hull area penetrate the surface of the water. The liquid within the cavity is against the upper transparent pane above the surface of the water. Any air bubbles are expelled from the outer surface of the lower transparent pane via the vertical vents and allowing the lower pane to be in full contact with the water in which the craft floats. The user lies prone in total relaxed comfort. The users eyes are positioned directly over and within inches of the upper transparent pane of the viewing area with no visual restrictions or facial confines. The view through the viewing area from the upper transparent pane immediately into water to the objects below is crystal clear and magnified. The same arrangement when using a mask; eyes, air space, lens, water. Condensation or fogging within or upon the viewing area can not occur. Water that is splashed by waves or other swimmers onto the slanted upper transparent pane of the viewing area runs off automatically into and down the scuppers. A viewing area providing an absolute trouble free view below the water equal to that provided by a conventional snorkel mask, and combined with a craft that allows that view to be enjoyed by virtually anyone from the very young to very old with no modifications of the craft or viewing area required.

Conclusion, Ramifications, and Scope

Accordingly, the reader will see that the rigid and inflatable crafts, with an underwater viewing area, can be manufactured very economically by providing a simple means to view below the surface of the water that requires no tooling costs for molds and other related costs. The viewing area of these crafts are filled with a transparent liquid, such as water, through a vent that is removed from the viewing area. The view that is provided is broad in field of view, crystal clear and magnified twenty five times. The forming of fog or condensation on the inner or outer surface of the transparent panes, due to climate changes or users breath is eliminated. The view provided is achieved without the need to block extraneous water or light with cowls or facial ports. Removal of splashed or otherwise extraneous water from the viewing area is automatic because of a slanted upper surface of the viewing area. Nothing can obscure or otherwise disrupt the users view below the surface of the water. In addition, the view provided is further enhanced by the craft within which the viewing area is comprised and in conjunction with. The comfort provided is matched only by that which water provides for a person floating prone while snorkeling with conventional snorkel gear. Furthermore, the craft does not constrict or confine a users head or face. An open-air space across the beam of the craft between the users face and the viewing area provides good ventilation and maintains peripheral view and an overall sense of the surroundings. An obvious safety feature since viewing below the surface of the water requires the head to be down in any case. Further visual restrictions are obviously unwise.

The present invention furthermore provides other advantages in that the viewing area of the craft is not defined by any particular shape or dimension whether horizontally, laterally, or vertically. It can be perfectly rectangular, boxed, or oval. Vertically, it can be trapezoidal or square.

The transparent liquid with which the viewing areas cavity is filled to total occupation can be water that is treated with a number of chemicals such as bleach to prevent browning or algae growth, prolonging refill intervals. This chemical treatment could be supplied by the manufacturer or being commonly known and available, obtained by the user. Additionally, the transparent liquid could be that of a chemical make up that was immune to discoloration or growth and in certain applications could be permanently sealed within the viewing area.

The craft, whether rigid or inflatable, can be of any color, shape, or length that does not compromise the comfort and ease of use presently provided for. A rigid craft, possessing the embodiments of present, could be constructed in means and materials other than roto-molding or blow molding. Examples such as, but not limited to, foam, reaction injection molding, or fiberglass. The head support and deck of the rigid craft presently padded, could be void of padding. The crafts providing an underwater light that is an integral part of the craft or removable for viewing below the water at night. The underwater lighting could be specially designed and fitted to the craft or could be a means of illumination presently being manufactured. Means by which to provide such lighting could be, but not limited to, recessed housing within the craft into which an underwater light containing it's own power source could be attached into the craft for use, then removed or an underwater light that is affix into the crafts hull with a remote power source that remains within the craft. Another means of lighting could be to manufacture the craft with one or more vertical portals through the crafts bow of sufficient diameter to accept a handheld type of dive light. The light(s), held captive within the craft, would extend down through the portal with the lens of the light(s) flush with the hull of the craft breaking the surface of the water coming up into the portal, when the craft is launched.

Thus the scope of the invention should be determined by the appended claims and their equivalents, rather than by the examples given.

I claim:

1. A personal swim craft having an underwater viewing area comprising:

a. a deck portion where upon a person lying prone is held in total body support, comfort, and ergonomic alignment replicating that which is experienced when a person floats prone in the water;

b. a head support near the bow of said craft that rises above the horizontal plane of said craft's deck that comfortably supports the head of a user, placing eyes directly over said viewing area and aligns the users neck and spine in a natural, comfortable, and strain free manner;

c. a freeboard or side portion of said craft, port and starboard, that slants downwardly and outwardly from said deck that allows the arms to be supported by said sides of said craft in a downwardly position removing stretch and strain from said-users chest and shoulders and allowing full range of motion when paddling;

d. a walled cavity within said craft which is sealed with an upper and lower transparent pane at upper and lower openings of said cavity, forming a watertight void between said upper and lower transparent panes and filled with a transparent fluid;

e. a vent for the filling of said void, completely with a transparent liquid eliminating all air bubbles, thus creating said underwater viewing area.

2. A personal swim craft according to claim 1 wherein said craft is rigid.

3. A personal swim craft according to claim 1 wherein said craft is inflatable.

4. An inflatable craft according to claim 3, wherein a. said deck is lower than the outer perimeters of said craft, positioning and cradling a user, such as a child, in the center of said craft automatically, preventing the user from falling off said craft.

5. A head support in combination with a viewing area, according to claim 1 that provides a non-restrictive or confined open-air facial environment that allows peripheral vision for safer operation.

6. A personal swim craft according to claim 1 wherein vertical vents extending through said craft remove air trapped below lower surface of said viewing area.

7. A personal swim craft according to claim 1 wherein a gutter aft of said viewing area receives extraneous water from said upper viewing area.

8. An underwater viewing area according to claim 1 wherein said upper transparent pane is slanted aft for immediate removal of extraneous water.

9. An underwater viewing area according to claim 1 wherein said vent for filling said cavity with a transparent liquid extends through said craft.

10. An underwater viewing area according to claim 3 wherein said vent for filling said cavity with a transparent liquid is within said upper transparent pane of said craft.

11. An underwater viewing area according to claim 1 wherein said transparent liquid is water.

12. An underwater viewing area according to claim 11 wherein said water is chemically treated to prevent discoloring and algae.

13. An underwater viewing area according to claim 1 wherein said transparent panes are one of acrylic and polycarbonate.

14. An underwater viewing area according to claim 1 wherein said transparent panes are of a rigid transparent material.

15. An underwater viewing area according to claim 1 wherein said transparent panes are tempered glass.

16. An underwater viewing area according to claim 1 wherein said transparent panes are installed over the upper and lower extremities of said cavity by means of electronic welding.

* * * * *